US012805647B2

(12) United States Patent
Wang

(10) Patent No.: US 12,805,647 B2
(45) Date of Patent: Nov. 24, 2026

(54) LIGHTWEIGHT GEL SLEEVE

(71) Applicant: Ningbo Bolishun Commodity Co., Ltd, Ningbo (CN)

(72) Inventor: Jingrong Wang, Ningbo (CN)

(73) Assignee: Ningbo Bolishun Commodity Co., Ltd., Ningbo (CN)

( * ) Notice: Subject to any disclaimer, the term of this patent is extended or adjusted under 35 U.S.C. 154(b) by 365 days.

(21) Appl. No.: 18/132,973

(22) Filed: Apr. 11, 2023

(65) Prior Publication Data

US 2023/0363548 A1 Nov. 16, 2023

(30) Foreign Application Priority Data

May 12, 2022 (CN) ..... 202221524040.2

(51) Int. Cl.
*A47C 27/08* (2006.01)
*A47G 9/10* (2006.01)

(52) U.S. Cl.
CPC ..... *A47C 27/085* (2013.01); *A47G 9/10* (2013.01)

(58) Field of Classification Search
CPC ..... A47C 27/085; A47G 9/10; A47G 9/1081; A47G 9/0253
USPC ..... 5/655.5
See application file for complete search history.

(56) References Cited

U.S. PATENT DOCUMENTS 10,882,576 B2 * 1/2021 Sung ..... B62J 1/26
2008/0244832 A1 * 10/2008 Kuo ..... A47C 27/007 5/490
2011/0094033 A1 * 4/2011 Lee ..... A47G 9/109 5/636
2012/0117733 A1 * 5/2012 Chen ..... A47G 9/1009 5/652
2012/0278992 A1 * 11/2012 Ou ..... A47G 9/0253 5/638
2014/0033438 A1 * 2/2014 Chen ..... A47G 9/109 5/636
2022/0400870 A1 * 12/2022 Micklos ..... B32B 3/12
2023/0356497 A1 * 11/2023 Taylor ..... B32B 5/18

* cited by examiner

*Primary Examiner* — Myles A Throop
(74) *Attorney, Agent, or Firm* — Jose Cherson Weissbrot

(57) ABSTRACT

The present invention discloses a lightweight gel sleeve, which comprises a top gel layer, a bottom gel layer and a lateral gel layer, wherein the top gel layer defines a middle cavity, and the lateral gel layer extends upward from the outer edge of the bottom gel layer to connect the bottom gel layer to the top gel layer; the top gel layer, the bottom gel layer and the lateral gel layer enclose an internal space, and the bottom gel layer defines a central opening communicated with the internal space through the gel layers, the central opening provides a passage through the gel layers and the internal space, and the top gel layer, the bottom gel layer and the lateral gel layer are integrally formed.

6 Claims, 8 Drawing Sheets

LIGHTWEIGHT GEL SLEEVE

TECHNICAL FIELD

The present invention relates to the technical field of bedding, in particular to a lightweight gel sleeve.

BACKGROUND

A certain concentration of polymer solution or sol, under appropriate conditions, the viscosity gradually increases, and finally loses its fluidity, and the whole system becomes an elastic semisolid with uniform appearance and certain shape, which is called gel.

Gel is a solid in liquid, which has good energy absorption and buffering function. At the same time, its touch is very similar to human skin, so it is widely used in pillows that are close to human body and play a role in buffering and supporting human body.

In the prior art, pillows made of gel materials are usually composed of pillowcases, gel pads and fillers. For example, U.S. Patent Publication No. US20210127865A1 discloses a pillow including a gel-like elastomer cushioning material, which includes a first pillow that defines a first main surface of the pillow, a second pillow coupled thereto at an interface, and a pillowcase that surrounds the first and second pillows. The first pillow pad is mainly composed of gel-like elastomer and defines the first main surface of the pillow. The first pillow is sized and configured to support the head and neck of a person using the pillow. The first pillow includes a deformable wall member extending between the first major surface and the interface. The deformable wall member is positioned and configured to define a gap therebetween such that the deformable wall member can be displaced into an adjacent gap when the deformable wall member is deformed. When the pressure applied to the first main surface of the first pillow in a direction perpendicular to the first main surface exceeds a threshold pressure level, the deformable wall member is configured to bend. The second pillow defines a second major surface of the pillow opposite to the first major surface. The material composition of the second pillow is different from that of the first pillow.

In the gel pillow adopting this solution, the first pillow is directly superimposed on the second pillow, and the air in the pillow can only circulate up and down. When the first pillow is pressed and deformed, the air in the pressure interval will be compressed, and the human body will be pressed by the compressed air in addition to the elastic force of the deformable wall. At the same time, the air in the pillow cannot communicate with the outside air, which will also increase the probability of sanitary problems in the pillow and greatly reduce the comfort of the pillow. In addition, when the pillow is subjected to the vertical downward pressure of the human body, the user will also give the pillow a lateral thrust in the process of turning over when sleeping, and the pillow in this solution only contacts with the filler through the surface, when the thrust is greater than the friction between the pillow and the filler, there will be displacement between the pillow and the filler, and at this time, a part of the pillow will lose the support of the filler. However, the pillowcase that suits the pillow pad and the filler is made of fabric sleeve close to human skin. Because of its high tensile property and softness, the fabric sleeve can't effectively prevent the gel pad and the filler from shifting, and it can't be reset after shifting, resulting in that the pillow can't effectively support the user's head or neck for a long time, which easily makes the pillow uneven and greatly reduces the use comfort of the pillow. In order to restore it to its original state, it is extremely inconvenient to disassemble the pillow.

Based on the above, it is necessary to provide a gel pillow with good air permeability, which can effectively support the head or neck of a human body for a long time. The air in the pillow can not only circulate up and down, but also circulate left and right, and at the same time, it can avoid the uneven pillow caused by the displacement between the pillow and the filler.

SUMMARY

The present invention provides a lightweight gel sleeve. The lightweight gel sleeve includes a top gel layer, a bottom gel layer and a lateral gel layer, wherein the top gel layer defines a middle cavity, and the lateral gel layer extends upward from the outer edge of the bottom gel layer to connect the bottom gel layer to the top gel layer; the top gel layer, the bottom gel layer and the lateral gel layer enclose an internal space, and the bottom gel layer defines a central opening communicated with the internal space through the gel layers, the central opening provides a passage through the gel layers and the internal space, and the top gel layer, the bottom gel layer and the lateral gel layer are integrally formed.

In the embodiment of the present invention, the top gel layer is a double-layer gel structure, and the double-layer gel is provided with a plurality of air holes, the central shafts of the air holes are not coincident and are distributed in a honeycomb shape, a middle cavity is defined in the double-layer gel, a cloth with good air permeability is arranged in the middle cavity, and the cloth enters the middle cavity through the side opening of the lateral gel layer.

In other embodiments, the lateral gel layer and the bottom gel layer can also adopt the same double-layer gel structure as the top gel layer, and the central opening of the bottom gel layer can be any desired geometry.

BRIEF DESCRIPTION OF DRAWINGS

In order to explain the technical solution of this application more clearly, the drawings needed in the implementation will be briefly introduced below. Obviously, the drawings described below are only some implementations of this application. For those skilled in the art, other drawings can be obtained according to these drawings without creative work.

IN THE FIGURES

Figure 1:
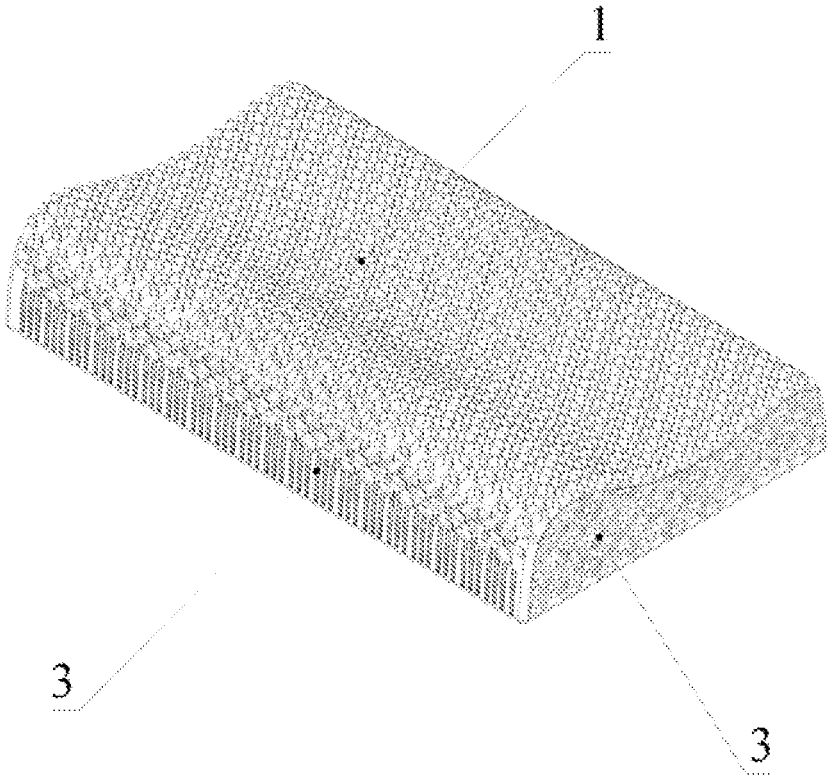
FIG. 1 is a schematic view of a gel sleeve.
Figure 2:
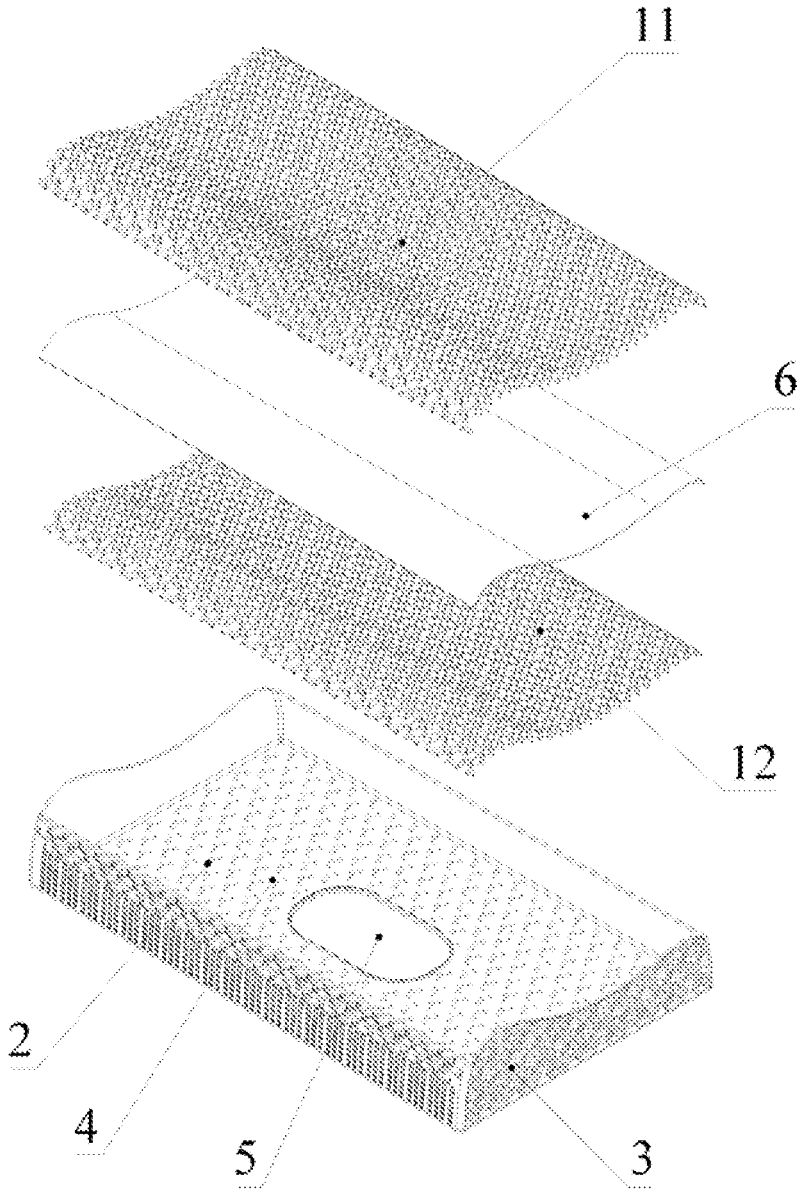
FIG. 2 is a schematic diagram of separation of the top gel layer.
Figure 3:
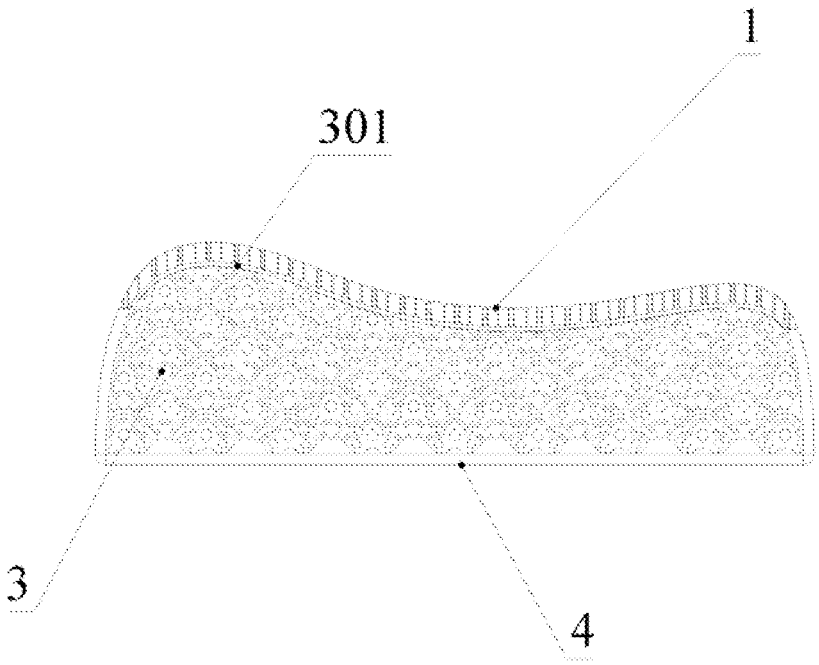
FIG. 3 is a schematic view of a lateral gel layer.
Figure 4:
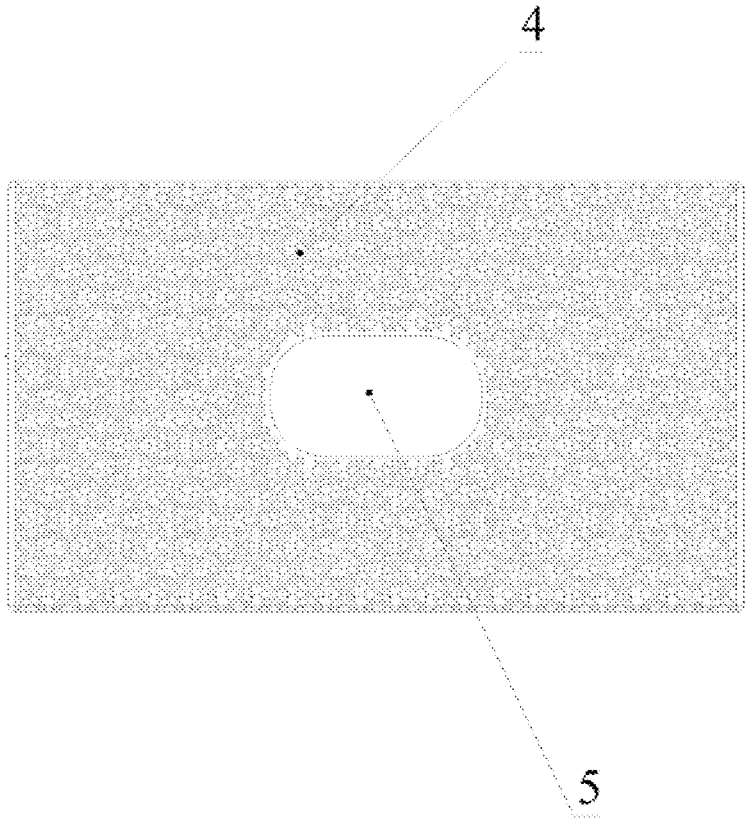
FIG. 4 is a schematic view of the bottom gel layer.
Figure 5:
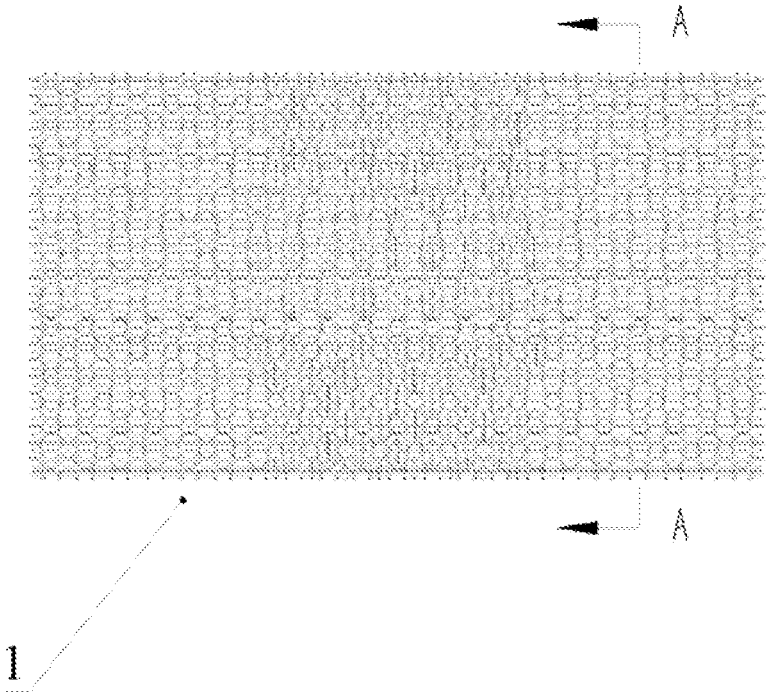
FIG. 5 is a top view of the top gel layer (without cloth)

1, Top gel layer; 11, Top gel layer; 111, Air hole; 1111, Central shaft; 12, Top gel layer; 121, Air holes; 1211, the central shaft; 13, Middle cavity; 2, Bottom gel layer; 21, Bottom gel layer; 22, Bottom gel layer; 3, Lateral gel layer; 301, Side opening; 31, Lateral gel layer; 32, Lateral gel layer; 4, Internal space; 5, Central opening; 6, Cloth; 7, Filler.

DESCRIPTION OF EMBODIMENTS

In the following, the technical solution in the embodiment of the application will be clearly and completely described with reference to the drawings in the embodiment of the application. Obviously, the described embodiment is only a part of the embodiment of the application, but not the whole embodiment. Based on the embodiments in this application, all other embodiments obtained by those skilled in the art without creative labor belong to the protection scope of this application.

Reference to "an embodiment" or "an embodiment" herein means that a particular feature, structure or characteristic described in connection with an embodiment or an embodiment can be included in at least one embodiment of this application. The appearance of this phrase in various places in the specification does not necessarily refer to the same embodiment, nor is it an independent or alternative embodiment mutually exclusive with other embodiments. It is understood explicitly and implicitly by those skilled in the art that the embodiments described herein can be combined with other embodiments.

In this specification, for the sake of convenience, words and expressions indicating orientation or positional relationship such as "middle", "upper", "lower", "front", "rear", "vertical", "horizontal", "top", "inner" and "outer" are used to illustrate the positional relationship of constituent elements with reference to the attached drawings, only for the convenience of description. The positional relationship of the constituent elements is appropriately changed according to the direction of the described constituent elements. Therefore, it is not limited to the words and expressions described in the specification, and can be replaced appropriately according to the situation.

As shown in FIGS. 1 to 7, a lightweight gel sleeve provided by the present invention includes a top gel layer 1, a bottom gel layer 2 and a lateral gel layer 3, wherein the top gel layer 1 includes a top gel layer 11 and a top gel layer 12, and the top gel layer 11 and the top gel layer 12 define a middle cavity 1; the lateral gel layer 3 extends upward from an outer edge of the bottom gel layer 2 to connect the bottom gel layer 2 to the top gel layer 1; wherein the top gel layer 1, the bottom gel layer 2 and the lateral gel layer 3 enclose an internal space 4, and the bottom gel layer 2 define a central opening 5 communicated with the internal space 4 through the gel layers; the central opening 5 provides a passage through the gel layers and the internal space 4, and the top gel layer 1, the bottom gel layer 2 and the lateral gel layer 3 are integrally formed.

Figure 6:
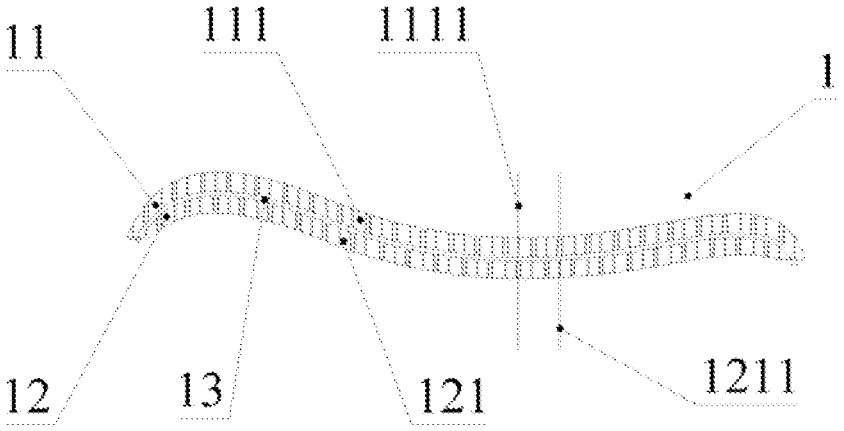
FIG. 6 is a sectional view taken along A-A in FIG. 5.

As shown in FIG. 6, as a preferred embodiment of the present invention, the top gel layer 1 adopts a double-layer gel structure, including a top gel layer 11 and a top gel layer 12, wherein the top gel layer 11 is arranged above the top gel layer 12, and a middle cavity 13 is defined between the top gel layer 11 and the top gel layer 12.

In order to make the gel pad have better air permeability and better disperse the pressure on the head and neck of human body, the top gel layer 11 is provided with a plurality of air holes 111, and the top gel layer 12 is also provided with a plurality of air holes 111 and 112, which are all distributed in a honeycomb shape, and the central shafts 1111 and 1211 of the air holes 111 are not coincident.

In this embodiment, the top gel layer 11 with honeycomb-shaped air holes 111 can evenly disperse the pressure from the head and neck of human body, while the top gel layer 12 arranged below the top gel layer 11 can support the top gel layer 11, so as to avoid the top gel layer 11 from being deformed greatly, thus affecting the comfort of the headrest. Wherein the middle cavity 13 defined between the top gel layer 11 and the top gel layer 12 is configured to make the air circulation between the top gel layer 11 and the top gel layer 12 smoother, and the air in the air holes 111 and 121 can not only circulate up and down in the holes, but also circulate left and right through the middle cavity 13.

In addition, the middle cavity 13 communicates with the outside air through the side opening 301 of the lateral gel layer 3. Therefore, the air in the air holes 111 and 121 can still communicate with the outside air, which makes the top gel layer 1 have high air permeability as a whole. When a user uses a headrest, the air in the air holes 111 and 121 can flow in the middle cavity 13 to avoid that when the top gel layer 1 is deformed, the compressed air in the hole may give a reverse force to the head and neck of the user, thus affecting the comfort of the headrest.

At the same time, the top gel layer 1 can be kept dry by communicating with the outside air, so as to avoid the problem that the top gel layer 1 is affected by human body secretions, and bacteria and the like breed in the air holes, which causes sanitary conditions. In this embodiment, the central shaft 1111 of the air hole 111 is configured not to coincide with the central shaft 1211 of the air hole 121. This configuration method will cause the air hole 111 and the air hole 121 to be misaligned with each other, so that the air in the air hole 111 and the air hole 121 can be better circulated, and the air permeability of the top gel layer 1 is better.

In order to make the top gel layer 1 have better cushioning support performance, the cross-sectional area of the air holes 111 of the top gel layer 1 is configured to be smaller than that of the air holes 121 of the top gel layer 2, and the density of the air holes 111 distributed on the top gel layer 1 is greater than that of the air holes 121 on the top gel layer 121, so that the top gel layer 11 can have higher flexibility when supporting the head and neck of a human body. The user is more comfortable when resting on the headrest. At the same time, the cross-sectional area of the air holes 121 on the top gel layer 12 is larger than that of the air holes 111, and the distribution density is smaller than that of the air holes 111 on the top gel layer 11. Therefore, the softness of the top gel layer 12 is lower than that of the top gel layer 11, and the top gel layer 12 can effectively provide support for the top gel layer 11.

At the same time, in the middle cavity 13 defined between the top gel layer 11 and the top gel layer 12, there is also a cloth 6 with good air permeability, and the cloth 6 is configured to provide cushioning support for the top gel layer 1, so as to prevent the deformed part of the top gel layer 1 from sinking into the middle cavity 13 when a user is headrest, so that the top gel layer 1 cannot uniformly disperse the pressure on the head and neck of a human body, resulting in the decrease of pillow comfort.

The arrangement of the cloth 6 can effectively provide buffering support for the top gel layer 11, and prevent the deformed part of the top gel layer 11 from entering the middle cavity 13, thus causing greater deformation. In addition, the cloth 6 is made of a material with good air permeability, thus ensuring air circulation in the air holes 111 and 121. In addition, the cloth 6 can absorb human body secretions. In this embodiment, the cloth 6 can be replaced through the side opening 301, which greatly reduces the probability of hygiene problems of the top gel layer 1 and prolongs the service life of the top gel layer 1.

In some embodiments, the cloth 6 can be made of a denatured viscose fiber material; In other embodiments, the cloth 6 can be made of mulberry silk material; In other embodiments, the cloth 6 can be made of pure cotton cloth; In other embodiments, the cloth 6 can be made of a natural linen cloth; In other embodiments, the cloth 6 can also be made of a cloth with better air permeability.

Figure 7:
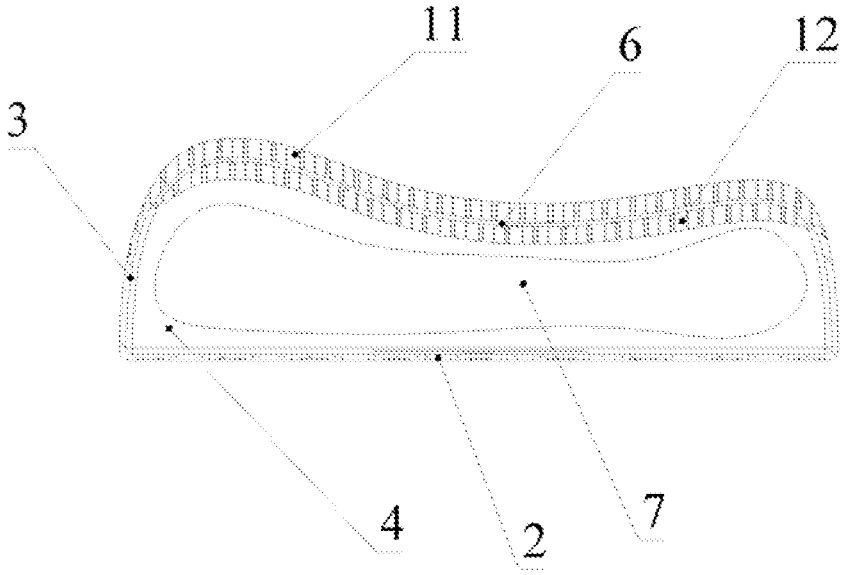
FIG. 7 is a sectional view of the gel sleeve.

As a preferred embodiment of the present invention, as shown in FIG. 7, an inner space 4 enclosed by a top gel layer 1, a bottom gel layer 2 and a lateral gel layer 3 is configured to place a filler 7. Unlike the U.S. patent publication No. US20210127865A1, the filler 7 of this embodiment is not only in contact with the lower surface of the top gel layer 1, but also surrounded by the bottom gel layer 2 and the lateral gel layer 3, wherein the lateral gel layer 3 extends upward from the outer edge of the bottom gel layer 4 and is connected with the outer edge of the top gel layer 1, and the top gel layer 1, the bottom gel layer 2 and the lateral gel layer 3 are integrally formed.

Therefore, the lateral gel layer 3 forms a fence for the filler 7, and the lateral gel layer 3 that forms a fence for the filler 7 will prevent the filler 7 from moving relative to the top gel layer 1 when the user turns over when sleeping, thus effectively avoiding that part of the top gel layer 1 loses the cushioning support of the filler 7 due to the relative displacement of the filler 7, thus affecting the comfort of the pillow.

In this embodiment, both the bottom gel layer 2 and the lateral gel layer 3 are single-layer gel structures, and in order to enhance the air permeability of the pillow, a plurality of air holes are formed on both the bottom gel layer 2 and the lateral gel layer 3, so that the air in the enclosed space 4 can also circulate with the outside air, and the probability of sanitary problems of the filler 7 is reduced.

Figure 8:
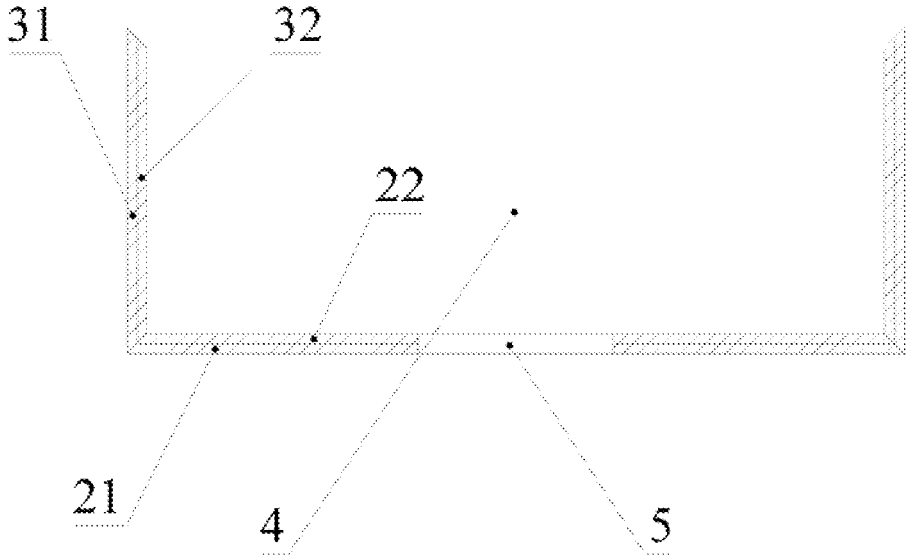
FIG. 8 is a cross-sectional view of a bottom gel layer and a lateral gel layer of another embodiment.

In some embodiments, the bottom gel layer 2 and the lateral gel layer 3 can also adopt the same double-layer gel structure as the top gel layer 1. As shown in FIG. 8, the bottom gel layer 2 includes the bottom gel layer 21 and the bottom gel layer 22, and the lateral gel layer 3 includes the lateral gel layer 31 and the lateral gel layer 32. This arrangement can make the gel sleeve have better structural strength and longer service life, while not reducing its air permeability and cushioning support performance.

As a preferred embodiment of the present invention, the bottom gel pad 2 defines a central opening 5 communicating with the internal space 4 through the gel layer, and the central opening 5 provides a passage passing through the gel layer and the internal space 4, and the filler 7 can be taken out of the internal space 4 for cleaning or replacement through the passage provided by the central opening 5. In addition, in the production process, the central opening 5 can also be used as a mold opening for demoulding the product mold, and its shape can be any desired geometric shape such as rectangle, circle, star, ellipse, etc.

This arrangement can further improve the applicability of the lightweight gel sleeve provided by the present invention, and users can select the appropriate filler 7 according to actual needs to show different buffering and supporting effects. At the same time, the filler 7 can be taken out for cleaning or replacement, which also reduces the probability of sanitary problems of the gel sleeve and greatly prolongs the service life of the gel sleeve.

In this embodiment, the filler 7 is made of polyurethane sponge with good air permeability, which has the advantages of softness, comfort and air permeability, and also has a memory function, which can play a better buffering and supporting role for the top gel layer 1.

In other embodiments, for example, in summer, the filler 7 can be made of 3D spinnerets with good cooling effect and good air permeability. In other embodiments, for example, in winter, the filler 7 can also be made of materials with good thermal insulation effect, so that the pillow can achieve better thermal insulation effect.

The lightweight gel sleeve provided by the present invention can also be used as a pillowcase, and the pillowcase can be made of materials close to human skin and having good air permeability and tensile properties, and the pillowcase can protect the gel sleeve, avoid sanitary problems caused by direct contact of human skin with the gel sleeve, and greatly prolong the service life of the gel sleeve.

The technical means disclosed in the solution of the present invention are not limited to the technical means disclosed in the above embodiments, but also include the technical solution composed of any combination of the above technical features. It should be pointed out that for those skilled in the art, several improvements and embellishments can be made without departing from the principle of the present invention, and these improvements and embellishments are also regarded as the protection scope of the present invention.

What is claimed is:

1. A gel sleeve, comprising:

a top gel layer, wherein the top gel layer comprises a first top gel layer and a second top gel layer, and the first top gel layer and the second top gel layer define a middle cavity, wherein the first top gel layer is provided with a plurality of holes and the second top gel layer is provided with a plurality of holes, wherein each hole of the plurality of holes of the first top gel layer extends through the first top gel layer, and each hole of the plurality of holes of the second top gel layer extends through the second top gel layer, the plurality of holes of the first top gel layer is distributed in a honeycomb shape throughout the first top gel layer and the plurality of holes of the second top gel layer is distributed in the honeycomb shape throughout the second top gel layer, wherein a first cross-sectional area of each hole of the plurality of holes of the second top gel layer is larger than a second cross-sectional area of each hole of the plurality of holes of the first top gel layer, and a distribution density of the plurality of holes of the second top gel layer is lower than a distribution density of the plurality of holes of the first top gel layer, each hole of the plurality of holes of the first top gel layer has a first central shaft and each hole of the plurality of holes of the second top gel layer has a second central shaft and the first central shaft is misaligned with the second central shaft;

wherein the first central shaft and the second central shaft are arranged such that the plurality of holes of the first top gel layer and the plurality of holes of the second top gel layer are misaligned with each other, wherein the middle cavity defines a lateral airflow channel between the first top gel layer and the second top gel layer such that air entering a through-hole of the first top gel layer travels laterally within the middle cavity before entering a through-hole of the second top gel layer, a bottom gel layer having an outer edge; and a lateral gel layer, the lateral gel layer extends upward from the outer edge of the bottom gel layer to connect the bottom gel layer to the top gel layer, wherein the top gel layer, the bottom gel layer and the lateral gel layer enclose an internal space, and the bottom gel layer define a central opening communicated with the internal space through the first top gel layer and the second top gel layer, the central opening provides a passage through the first top gel layer, the second top gel layer and the internal space, and the top gel layer, the bottom gel layer and the lateral gel layer are integrally formed.

2. The gel sleeve according to claim 1, wherein the bottom gel layer and the lateral gel layer are provided with a plurality of air holes.

3. The gel sleeve according to claim 2, wherein the lateral gel layer further comprises a side opening, and the middle cavity communicates with the outside air through the side opening.

4. The gel sleeve according to claim 3, wherein a cloth is arranged in the middle cavity, and the cloth enters the middle cavity through the side opening.

5. The gel sleeve according to claim 3, wherein the bottom gel layer comprises a first bottom gel layer and a second bottom gel layer, and the lateral gel layer comprises a first lateral gel layer and a second lateral gel layer.

6. The gel sleeve according to claim 1, wherein the shape of the central opening is rectangular, circular, star-shaped or oval.

* * * * *